US007575545B2

(12) United States Patent
Ratz

(10) Patent No.: US 7,575,545 B2
(45) Date of Patent: Aug. 18, 2009

(54) LONGITUDINAL FOLDING DEVICE

(75) Inventor: Holger Ratz, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/594,792

(22) PCT Filed: Mar. 31, 2005

(86) PCT No.: PCT/EP2005/051458

§ 371 (c)(1),
(2), (4) Date: Sep. 29, 2006

(87) PCT Pub. No.: WO2005/095245

PCT Pub. Date: Oct. 13, 2005

(65) Prior Publication Data

US 2007/0273087 A1 Nov. 29, 2007

(30) Foreign Application Priority Data

Apr. 1, 2004 (DE) ..... 10 2004 015 963

(51) Int. Cl.
*B31B 1/26* (2006.01)

(52) U.S. Cl. ..... 493/405; 493/444; 493/254; 493/437

(58) Field of Classification Search ..... 493/23, 493/405, 444, 254, 437
See application file for complete search history.

(56) References Cited

U.S. PATENT DOCUMENTS 2,172,361 A * 9/1939 Clauberg ..... 270/47
3,154,726 A * 10/1964 McClain ..... 361/179
3,899,166 A * 8/1975 Behn ..... 493/8
4,269,402 A * 5/1981 Fischer et al. ..... 493/437
5,147,276 A 9/1992 Stab
5,171,204 A * 12/1992 Muller ..... 493/444
5,267,935 A * 12/1993 Bialek et al. ..... 493/444
5,458,557 A * 10/1995 Bladie et al. ..... 493/444
6,019,714 A 2/2000 Stab
6,074,332 A * 6/2000 Helmstadter et al. ..... 493/254
6,305,146 B1 * 10/2001 Gerber ..... 53/116
6,808,480 B2 * 10/2004 Neubauer et al. ..... 493/458

FOREIGN PATENT DOCUMENTS

DE 40 20 937 C2 1/1992

(Continued)

*Primary Examiner*—Hemant M Desai
(74) *Attorney, Agent, or Firm*—Jones Tullar & Cooper, PC

(57) ABSTRACT

A system comprises alternative processing sections for use in the further processing of products. A separator, at which a transport section is divided into several alternative transport sections for the further processing of products in processing stages, is provided. A sensor, that detects the phasing of the products, is located upstream of the separator. A request from the sensor acts on a drive which actuates the separator through a control device. A further sensor, which detects the product phasing, is located on each of the at least two transport sections. This further sensor is connected to a drive for the processing stage served by respective ones of the separate transport sections. The drive of each such processing stage is controlled independently of the drive for the respective transport section by a suitable control unit which takes into consideration the detected product phasing for the associated transport section.

12 Claims, 7 Drawing Sheets

FOREIGN PATENT DOCUMENTS

| | | | | |
|---|---|---|---|---|
| DE | 198 28 625 | A1 | | 1/1999 |
| DE | 198 02 995 | A1 | | 8/1999 |
| DE | 198 02 995 | C2 | | 8/1999 |
| DE | 199 43 165 | A1 | | 3/2001 |
| DE | EP 1211212 | | * | 6/2002 |
| EP | 0 639 523 | B1 | | 10/1996 |
| EP | 0 873 273 | B1 | | 12/1996 |
| EP | 1 211 212 | A2 | | 10/2001 |
| GB | 1 326 891 | | | 8/1973 |
| GB | 2 333 768 | | | 8/1999 |

* cited by examiner

LONGITUDINAL FOLDING DEVICE

CROSS-REFERENCE TO RELATED APPLICATIONS

This patent application is the U.S. National Phase, under 35 USC 371, of PCT/EP2005/051458, filed Mar. 31, 2005; published as WO 2005/095245 A1 on Oct. 13, 2005, and claiming priority to DE 10 2004 015 963.7, filed Apr. 1, 2004, the disclosures of which are specifically incorporated herein by reference.

FIELD OF THE INVENTION

The present invention is directed to a system, which is provided with alternative processing sections for use in the further processing of products, and with a longitudinal folding apparatus, as well as to a method for the synchronous operation of a folding apparatus. A shunt is used to divide a product path into a plurality of alternative product paths. An upstream product sensor detects a product phase relationship and controls the shunt.

BACKGROUND OF THE INVENTION

In folding apparatuses, useable, in particular, for products of a rotary printing press, product sections or products are further processed in several successive and partially alternatively selectable processing stages. The alternative assignment of each of the product sections or products to one or another of several processing stages takes place by the use of a product shunt. In generally conventional folding apparatuses, the product shunt, as well as the tools or apparatus of the subsequent processing stages, are typically driven via gears from a main drive mechanism of the folding apparatus or its transport devices and are synchronized with them. However, if the product sections or products, prior to their entry into the shunt and/or prior to their entry in the downstream located processing stage, are not always exactly oriented, damage to the products can occur. This may result in a reduction in quality of the resultant product and may even result in the stoppage of the installation, either in the course of the passage of the product sections through the shunt, or during subsequent further processing of the product sections.

A product shunt of a folding apparatus, with two downstream located longitudinal folding apparatuses, is disclosed in DE 198 02 995 C2. A sensor, for use in detecting the phase relation of the product, is located upstream of the product shunt. Another sensor is located downstream of each of the two succeeding longitudinal folding apparatuses and is usable for detecting jams in these apparatuses. The three sensors, another sensor, which is usable for detecting the number of revolutions of the main drive mechanism, as well as a switching device for setting a production type, are all connected with a regulating arrangement for controlling the product shunt. The regulating arrangement acts on a step motor which is connected with the shaft of the product shunt.

A longitudinal folding apparatus is known from DE 40 20 937 C2. A folding blade can be moved toward and away from the folding apparatus by the use of a cam disk.

DE 199 43 165 A1 discloses a folding blade of a longitudinal folding apparatus. The folding blade can be moved into and out of the folding apparatus by the use of coils which generate electromagnetic force.

Longitudinal folding apparatuses are generally known and are employed in the printing industry, primarily in the finishing of printed products. The printed products are pushed into the folding gap by the folding blade and are longitudinally folded in it. The entry direction of the printed products into the longitudinal folding apparatus extends transversely with respect to their subsequent movement through the folding gap. It is therefore necessary to slow the printed products down, prior to their passage through the folding gap. Braking brushes, which gradually slow down the incoming printed products by friction, as well as stationary buffers, against which the printed products bump, and which printed products are abruptly braked by this, are known for this purpose in generally known longitudinal folding apparatuses. To avoid damage to the printed products at the buffers, it is necessary to reduce the speed to a low value. However, this value may in no case be zero. If the speed becomes zero, the printed products do not reach the buffer, and a jam occurs. The extent of the slow-down, by the use of the brushes, is determined by the friction that they exert on the printed products, and ultimately by the position of the latter. If it is intended to fold printed products of varied thickness, while the position of the brushes remains the same, the friction, which is exerted by the brushes, greatly increases with the thickness of the products. A thick product may possibly get stuck between the brushes and thus will not reach the buffer, while a thin product will bump against the buffer with such great speed that it becomes damaged in the process. Therefore, the position of the brushes must be matched to the thickness of the printed products.

The friction between printed products and brushes is also a function of the surface condition of the printed products. Products made of smooth paper can bump against the buffer too rapidly, while products made of rough paper, even though being of the same thickness and the same weight as the smooth paper products, possibly do not reach the buffer.

A further problem arises from the fact that the amount of kinetic energy of the printed products, which is dissipated at the brushes, is a result of the product of brush friction and the length of the braking path. The kinetic energy dissipation is independent of the entry speed of the printed products into the brushes. Changes of this entry speed, regardless of whether these changes are intentional or unintentional, therefore have a very strong effect on the bumping speed of the printed products on the buffer.

For all practical purposes, it is necessary to adjust the position of the brushes for each printing job in order to assure the correct functioning of the longitudinal folding apparatus. Based on the multitude of influencing parameters which are involved, the adjustment of the brush position can often only take place empirically, which trial and error adjustment results in a large outlay of time and costs.

A further basic problem, which occurs in connection with high entry speeds of the printed products, even when they are braked to such an extent that damage, because of bumping against the buffer, does not occur, results from the fact that the printed products change their position and orientation in the course of the braking process. In many cases, following its braking, a printed product assumes a twisted position in the longitudinal folding apparatus, in which twisted position, the front edge of the printed product no longer extends perpendicular to the folding gap. The printed product is therefore not folded, in the desired way, in the center in the course of subsequent folding, during which subsequent folding the printed product is pushed, in its twisted position, into the folding gap by the folding blade, and now has an oblique fold.

Premature folding can also occur if printed products are delayed in their entry the longitudinal folding apparatus. This is true particularly if driving of the folding blade, which is the tool of the processing change is provided by a main drive mechanism.

EP 1 211 212 A2 shows a folding blade control device of a longitudinal folding apparatus with a sensor arranged upstream of the longitudinal folding apparatus. A control of a folding blade triggering time is determined as a function of the speed of the transported product sections, as determined by the sensor.

DE 198 28 625 A1 relates to a transverse folding device for the transverse folding of sheets. It includes a folding blade that is inclined in the transport direction, as well as an automatic control for the position or the correct separation of the sheets. The device is capable of transversely folding sheets of paper once or several times.

SUMMARY OF THE INVENTION

The object of the present invention is directed to increasing the product quality and the operational dependability in a system with alternative processing sections which are usable for the further processing of products, and in a longitudinal folding apparatus. The object of the present invention is also directed to the provision of an appropriate method for the synchronous operation of a folding apparatus.

In accordance with the present invention, this object is attained by the provision of a system, with alternative processing tracks for use in the further processing of products in a longitudinal folding apparatus. A former and a transverse folding apparatus are arranged upstream of the longitudinal folding apparatus. A shunt is located where a product conveying path splits into a plurality of alternate transport tracks. A sensor detects the product phase relation upstream of the shunt. A signal from the sensor acts on a shunt drive via a control device. A further sensor is arranged on each of the transport tracks.

The advantages which can be obtained by the present invention consist, in particular, in that, on the one hand, the product quality, and, on the other hand, the operational dependability, or the availability of the folding apparatus, are considerably increased. This is advantageously accomplished by the optical detection of the position of the products, which are situated upstream of the two longitudinal folding apparatuses, and by the synchronization of the folding blade, which is driven mechanically independently from the conveying system and/or a movable buffer and/or an optical detection of the position of the products upstream of the shunt.

By the provision of the optical detection of the phase relation of the products, directly prior to longitudinal folding, it is possible to ideally synchronize the time of folding and to correct it, if required. The quality of the product is further improved if, in addition, movable buffers are also synchronized by the use of the optical detection. Such synchronization reduces the product bumping and assures an exact product alignment.

In an advantageous embodiment of the present invention, a gentle braking of the products, such as, for example, printed products, is achieved at the longitudinal folding apparatus by the use of the movable buffer. The kinetic energy, with which the products bump against the moving buffer, is reduced in comparison with the kinetic energy which is released in case of the products bumping against a stationary buffer. If a difference between an entry speed of the products, and a speed of the moving buffer is selected to be sufficiently low, it is even possible to completely prevent the above-described unintentional effects that are caused as a result of released kinetic energy. It is possible, in this case, to also absorb very high entry speeds of the products, by the use of the movable buffer. The products can accordingly be gently braked. A braking effect, which is independent of the mass, the thickness and the surface condition of the incoming products, can be achieved by the use of the movable buffer. It is thus possible to process different products without it being required to first adapt the longitudinal folding apparatus to each one of them.

In a particularly preferred embodiment of the present invention, the longitudinal folding apparatus contains a control unit which controls a reduction of the speed of the buffer on the braking path. A definite braking of the incoming products is possible, by the use of the control unit. The incoming products come to a buffer, at a predetermined defined position, and, in the process, are optimally aligned for the subsequent folding process. Alternatively, the incoming products can bump against a second, stationary buffer, which determines the desired position of the products for the subsequent folding process, at a reduced speed, at which reduced speed, no damage of the products because of their bumping is to be expected.

If the control unit has an input for a signal which input is, in particular, representative of the entry speed of the products, it is possible to comfortably match the speed of the buffer with changing entry speeds of the products by the use of the control unit.

A sensor, for use in detecting incoming products, is advantageously placed upstream of the braking path and is coupled to the control unit. The control unit can thereby synchronize the movement of the movable buffer in such a way that, at the entry to the braking path, a detected incoming product meets the buffer, which buffer moves at approximately the entry speed. The speed of the buffer, at the entry to the braking path, can be less than the incoming product entry speed as long as the difference between the two speeds is not so great so that damage to the product appears likely. The buffer speed can also be slightly greater than the product speed. In this case, contact between the two will then occur at a later location on the braking path, at which the speed of the buffer has then become slower than the speed of the product.

Preferably, the buffer is configured as a revolving cam, whose direction of movement crosses a braking path of the product, at least on one path section. With the aid of a revolving cam which is arranged on a rotatable body, such as, for example, a disk, a roller or an eccentric device, the buffer can be conveyed in continuous movement, without a reversal of the driving direction, from one end of the braking path, where it is moving out of contact with the product, back to its start, where it is coming into contact with the product, in order to catch the next arriving product there. In this case, the rotatable body can be provided as a module which can be retrofitted to the longitudinal folding apparatus and which is located above a folding table having the folding gap. Alternatively, the rotatable body with the cam may be arranged underneath the folding table as a module which is fixedly integrated into the longitudinal folding apparatus. In a preferred embodiment of the present invention, the body consists of several disks, which are arranged axially next to each other, and each of which has at least one cam on its circumference.

In a variation of the present invention, the cam can be arranged on a circulating endless belt. This endless belt has a section which extends parallel with the braking path.

Preferably at least one rotatable body, having a cam or an endless belt, is arranged on both sides of the folding gap, each of which rotatable body supports synchronously movable buffers. Two rotatable bodies, or two endless belts, per side of the folding gap are preferred. In this way, a correct alignment of the braked product is assured. Additionally, unintended twisting of the product, in relation to the folding gap, is made more difficult.

At least one motor for driving the rotatable bodies, or the endless belts, can be provided on both sides of the folding gap. This motor can be a highly dynamic servo motor or can be an electric motor. However, an embodiment of the present invention is also possible wherein a single motor drives the rotatable bodies or endless belts on both sides of the folding gap by the use of a continuous shaft.

A speed of the buffer, at the entry to the braking path, of at least 90% of the entry speed of the product is preferred. In that case, a sufficiently small difference exists between the speed of the buffer and the entry speed, so that only little kinetic energy is released when the products bump against the buffer.

It can be advantageous, in accordance with the present invention, to also provide braking brushes, besides the movable buffer, in the longitudinal folding apparatus. The inclusion of these braking brushes insures that braking of the products can be further gentled.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 1:
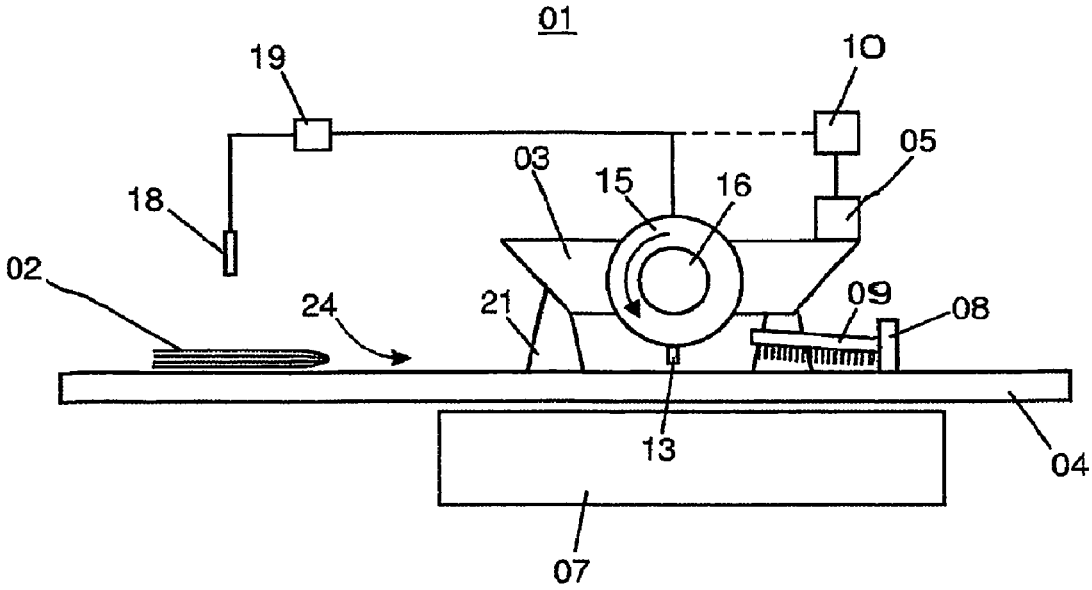
FIG. 1, a schematic side elevation view of a longitudinal folding apparatus in accordance with the present invention, in FIG. 2, a top plan view of the longitudinal folding apparatus of FIG. 1, in FIG. 3*a*) to FIG. 3*d*), a sequential process of braking a printed product, in FIG. 4, a speed/time diagram for a printed product in a first mode of operation of the longitudinal folding apparatus in accordance with the present invention, in FIG. 5, a speed/time diagram for a printed product in a second mode of operation of the longitudinal folding apparatus of the present invention, in FIG. 6, a side elevation view of a further longitudinal folding apparatus in accordance with the present invention, in FIG. 7, a top plan view of the longitudinal folding apparatus of FIG. 6, in FIG. 8, a perspective representation of a braking device with a movable buffer in accordance with the present invention, in FIG. 9, a perspective representation of a braking device with a folding table and frame, and in FIG. 10, a schematic representation of a system with alternating processing sections for the further processing of products in accordance with the present invention.
Figure 2:
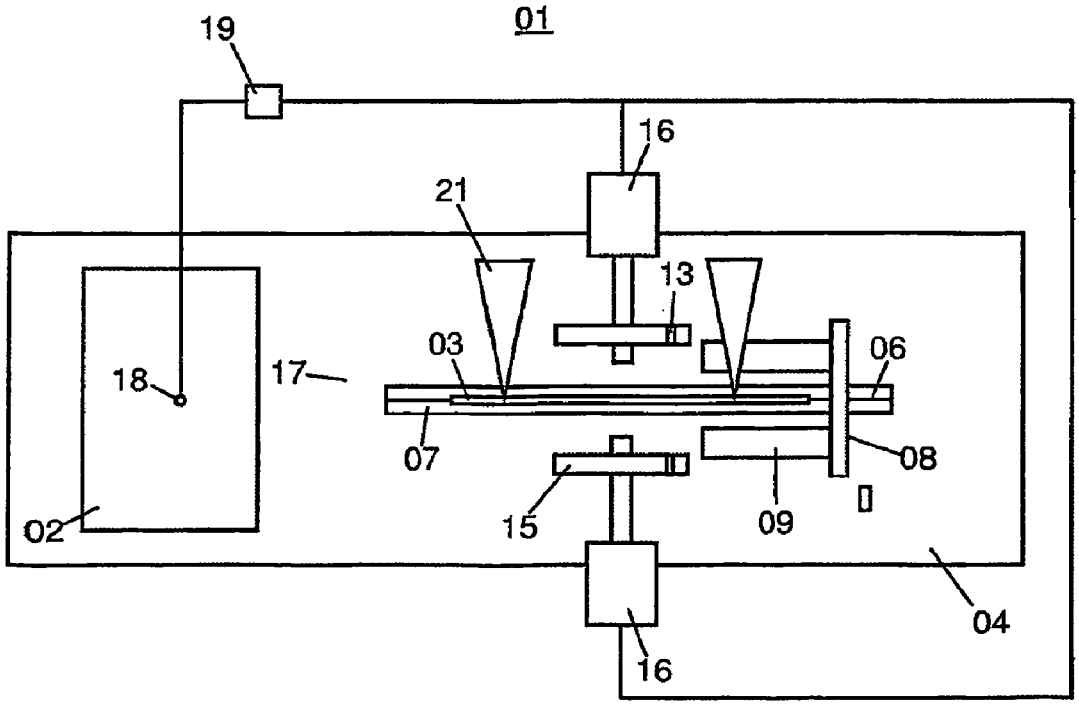
Figure 9:
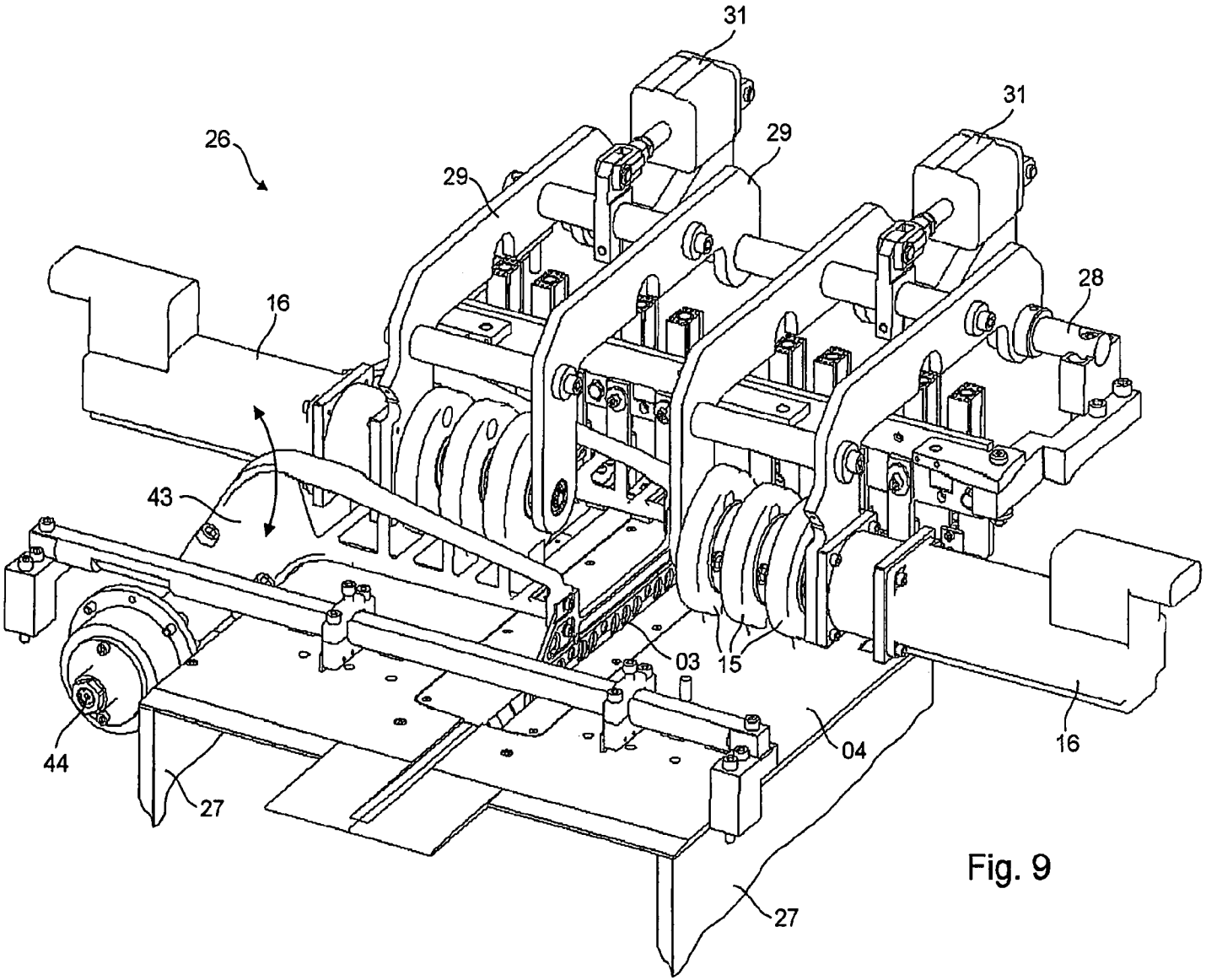

A processing stage 01, which is configured as a longitudinal folding apparatus 01, is represented in FIGS. 1 and 2, in a side elevation view in FIG. 1, and in a top plan view in FIG. 2. The longitudinal folding apparatus 01 consists of a folding table 04, in which an elongated folding gap 06 is provided, as seen in FIG. 2. A pair of folding rollers 07 have been placed against each other. Only one of the rollers 07 is visible in FIG. 1, while the other is hidden. This pair of folding rollers 07 are arranged underneath the folding table 04 at the level of a folding gap 06 in such a way that they form a folding roller gap which is oriented parallel with the folding table gap 06 and which is located directly underneath it. Pivotable folding levers 21 are provided on the folding table 04. These folding levers 21 hold a folding blade 03 above the folding gap 06, which folding blade 03 is also oriented parallel to the folding gap 06. In the course of a pivot movement of the folding levers 21, the folding blade 03 can enter into the folding gap 06. An elongated buffer 08 is arranged in an end area of the folding gap 06 and is oriented transversely, in respect to the folding gap 06, on the folding table 04. Braking brushes 09, which are facing the top of the folding table 04, are fastened on the buffer 08. The folding blade 03 is preferably embodied in the manner of a blade 04, which is pivotable with respect to the folding table 04, in contrast to a rotating cutter. The folding blade 03 can be moved up and down relative to the folding table 04. For example, the folding blade 03 may be seated in levers 43, which are in turn, pivotably seated around a shaft 44, as is shown in FIG. 9 in respect to the folding table 04. However, in another embodiment, the blade 03 can also be arranged eccentrically on a continuously turning rotatory body. Folding blade 03 can also be eccentrically arranged on a turning planetary wheel. In an advantageous embodiment of the invention, a mechanically independent drive mechanism, as will be described below has been provided.

In a preferred embodiment of the present invention, which is indicated only by dashed lines in FIG. 1, a folding blade drive mechanism 05, which is independent of the conveying or production devices, is assigned to the folding blade 03. This folding blade drive mechanism 05 can be configured as a motor 05, for example, which motor 05 lowers or raises the folding blade 03 in a clocked, or timed manner in respect to the position of a product 02 on the folding table 04 via a gear mechanism, such as, for example, an eccentric device or a crank drive. For example, the control of the drive mechanism 05 can take place by the use of a control device 10, which is represented in dashed lines. Control device 10 synchronizes the movement of the folding blade 03 with the product flow, either by the use of information regarding the speed of a transport system conveying the product 02, or by the use of a signal from a sensor, such as, for example, a sensor 18 which will be discussed below, and, which sensor 18 is arranged upstream of the folding gap 06 and detects the product 02.

Figure 5:
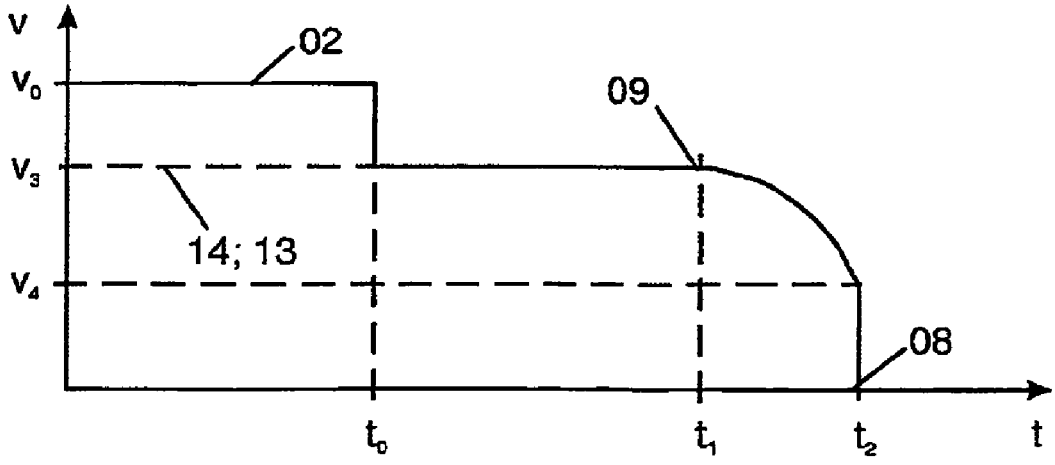
Figure 6:
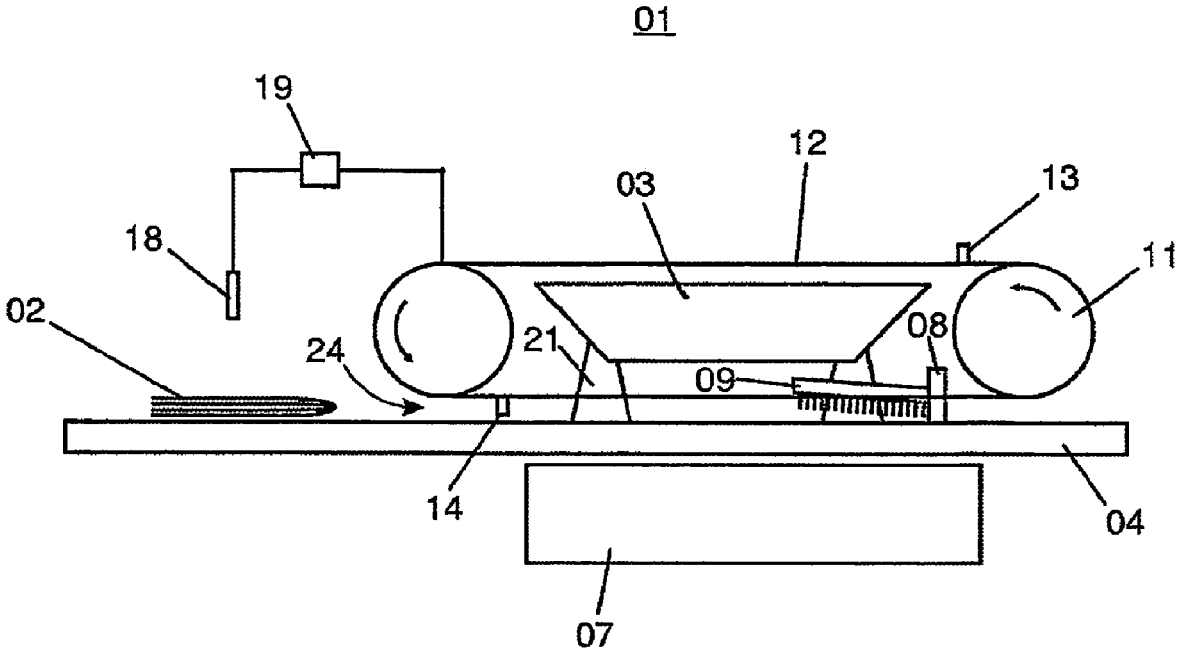

A rotatable body 15 in the form of, for example, disks 15, is respectively arranged on each of the sides of the folding gap 06. An axis of rotation of the rotatable body 15 extends perpendicular, with respect to the folding gap 06. Two buffers 13, 14, such as, for example, cams 13, 14, are arranged, such as, for example, by being welded to the circumference of the disks 15. Starting from any one of the cams or buffers 13, 14, a respective distance between the successive cams 13, 14, along the length of the disk 15 preferably is of the same length. Each of the two disks 15, which are located on opposite sides of the folding gap 06, is connected with a motor 16, such as, for example, with an orientation-regulated electric motor 16, and is preferably synchronously driven by its respective motor 16. In a variation of the preferred embodiment, which is not specifically represented, the two disks 15 can be connected with each other by a continuous shaft and can be driven by a common motor 16. A first side of a braking path 24 for printed products 02 is delimited by the upper surface of the folding table 04, and is delimited on a second side by a shell face of the two disks 15 facing this folding table upper surface. A distance between the upper surface of the folding table 04 and the shell faces of the disks 15 is greater than the height of the cams 13, 14. The motors 16 are controlled by a control unit 19, or a control device 19, which is furthermore connected to the sensor 18. For the detection of products 02, such as, for example, printed products 02, which are entering the brake path 24 delimited by the toothed disks 15 and the folding table 04 at an entry speed $v_0$, as seen in FIGS. 5 and 6, the sensor 18 has been placed upstream of the braking path 24 on the inlet side. The control unit 19 furthermore has an input for receiving a signal specifying the speed "v" with which the printed products 02 enter the braking path 24. For example, this signal can be derived from a web speed signal of a web-fed printing press producing the printed products 02, or can be made available from the control console of such a press. However, it is also possible to detect the speed "v" of each individual arriving printed product 02, for example with the aid of two sensors 18 which are successively being passed by the printed products 02, and to provide this speed "v" it to the input of the control unit 19.

Figure 7:
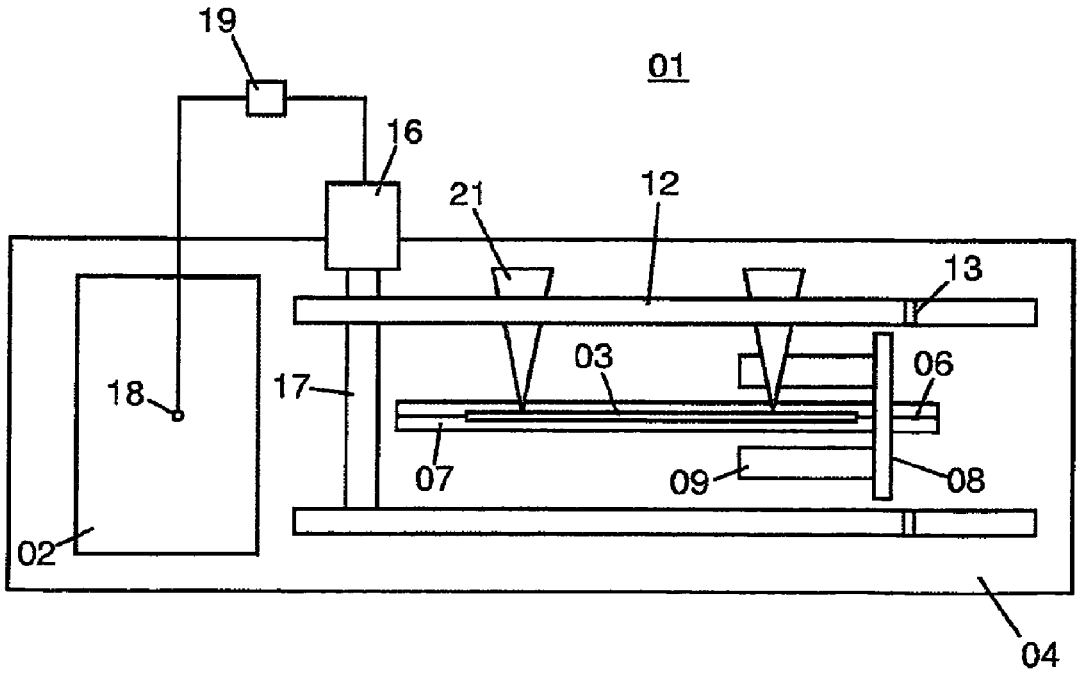

In a variation of the first preferred embodiment, as seen in FIGS. 6, 7, instead of the disk 15 supporting the cams 13, 14, a toothed belt 12, in the form of an endless belt 12, which belt 12 extends parallel with the folding gap 06, runs on both sides of the folding gap 06 and over two rotatably supported, and spaced, gear wheels 11, such as, for example, pulleys 11. Two buffers 13, 14, such as, for example, cams 13, 14, have been respectively welded, or otherwise secured to the toothed belt 12. Again starting from any one of the cams 13, 14, or buffers 13, 14 a distance between subsequent or sequential ones of the cams 13, 14, along the length of the toothed belt 12, is of the same length. Two of the gear wheels 11, which are located on different, opposite sides of the folding gap 06, are connected with each other by the continuous shaft 17, as seen in FIG. 7, and are connected with the common motor 16 by shaft 17, which motor 16 may be, for example an orientation-regulated electric motor 16. Gear wheels 11 are synchronously driven by the motor 16. The braking path 24 for the printed products is delimited, on the one side, by the top of the folding table 04, and on the other side by a strand of each of the two toothed belts 12 facing this top surface of the folding table 04. The distance between the surface of the folding table 04 and the strands of the two toothed belts 12 is slightly greater than the height of the cams 13, 14. The motor 16 is controlled by the control unit 19 which, as mentioned in connection with FIG. 1, is connected to the sensor 18.

In an embodiment of the present invention, which is not specifically represented, the disks 15, or the endless belts 12 and gear wheels 11, can be arranged on a side of the folding table 04 that is facing away from the printed product 02. The cams 13, 14 must then extend up through the folding table 04 in such a way that they project out of the surface of table 04 which is facing the printed product 02 to thereby function in the manner of a movable buffer for the printed product 02, at least over a portion of the path of travel of the printed product 02.

The process of braking of the incoming printed product 02 is represented in FIGS. 3*a*) to 3*d*), using the embodiment of the rotatable body 15. A representation of the folding blade 03 and of the folding rollers 07 has been omitted for the sake of clarity. Wherever possible, the embodiment with an endless belt 12 is shown in parentheses.

The printed product 02 entering the longitudinal folding apparatus 01 at an entry speed $v_0$ is detected by the sensor 18, as shown in FIG. 3*a*). By use of the signal which is present at the input of the control unit 19, which signal is either time of the detection of the product signal and/or a speed signal, the control unit 19 synchronizes the movement of the disks 15 (toothed belt 12) with that of the printed product 02 in such a way that, at the entry to the braking path 24, the printed product 02 meets a cam 13 or 14, in FIG. 3*b*). The cam 13, which, at this time, moves slower than the printed product 02 thus brakes the printed product 02 without damaging it. In the course of the passage of the cam 13 through the braking path 24, as shown in FIG. 3*b*), the control unit 19 continuously slows the rotating movement of the disks 15 (the movement of the toothed belts 12) until the printed product 02 has, for example, reached the braking brushes 09 and is slowed further by them. The printed product 02 finally encounters the buffer 08 at a speed "v", at which it is not damaged by bumping into the buffer 08. However, in the case where the braking brushes 09 are only arranged downstream of the location at which the printed product 02 comes out of engagement with the cam 13, the printed product 02 initially moves evenly at a reduced speed. FIG. 3*c*) shows the situation shortly before the encounter of the printed product 02 with the buffer 08, and FIG. 3*d*) the situation shortly after the encounter of the printed product 02 with the buffer 08. As soon as the cam 13 and the printed product 02 come out of engagement with each other, the disk 15 (the toothed belt 12) can be accelerated again. Now, the second cams 14 are located at the entry to the braking path 24, in time with the arrival of a subsequent printed product 02, and have a speed "v" which is suitable for braking this subsequent printed product 02.

In a simplified embodiment of the longitudinal folding apparatus 01, the braking brushes 09 can be omitted. However, in this simplified embodiment, it is necessary to brake the cams 13, 14 to a lower speed "v", as these cams 13, 14 are passing the buffer 08, than would be needed if there were braking brushes 09. This is necessary in order to prevent damage to the printed products 02 at the buffer 08 and the rebounding of the printed product off the buffer 08. Therefore, a larger capacity motor 16 is required in this simplified embodiment.

In a subsequent folding step, the printed product 02 is pushed, by the vertically reciprocable folding blade 03, through the folding gap 06 and into the gap which is defined between the two folding rollers 07, in a generally known manner, and is longitudinally folded in this way. This folding strip is a generally known process, so that it will not be addressed in greater detail at this point.

Figure 4:
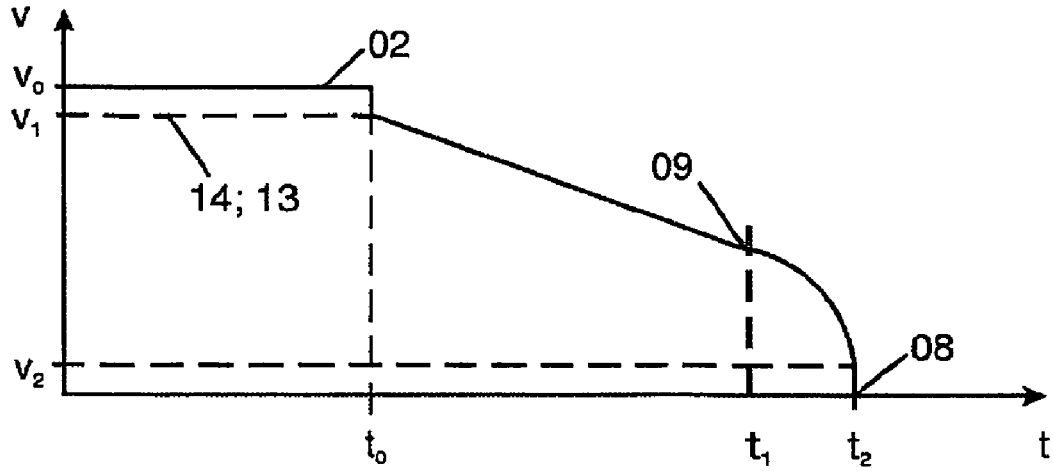

By way of example, FIG. 4 shows the chronological development, over time (t), of the speed "v" of a printed product 02 during its passage through the braking path 24.

The printed product 02 enters the longitudinal folding apparatus 01 at an entry speed $v_0$. The cams 14 or 13 initially precede the printed product 02 at a speed $v_1$, which speed $v_2$ is 90% of the entry speed $v_0$. At the time of an initial engagement of the printed product 02 against the cams 14 or 13, at the time $t_0$, the relative speed between the printed product 02 and the cams 14 or 13 is therefore one tenth of the printed product entry speed $v_0$. Because the relative speed enters the kinetic energy quadratically, this means that, in the course of the initial engagement or bumping of the printed product 02 against the cams 14 or 13, at the time $t_0$, only one hundredth of the kinetic energy is released as would be released in a case of the bumping or contact of the printed product 02 against the stationary buffer 08, at an unbraked entry speed $v_0$.

The speed of the cams 13, 14 is continuously reduced by the control unit 19 between the time $t_0$ and the time $t_1$, at which time $t_1$, the printed product 02 passes into the effective range of the braking brushes 09. A descending straight line for the speed $v_1$ results between these times $t_0$ and $t_1$, in the speed/time diagram, as shown in FIG. 4. Braking of the printed products 02, by the control unit 19, can also take place in a differently shaped curve. Starting at the time $t_1$, the printed product 02 is now additionally braked by the braking brushes 09, so that the straight line between the times $t_1$ and $t_2$ now shows a curvature, again as shown in FIG. 4. When the printed product 02 now finally bumps against the stationary buffer 08, at the time $t_2$, where it is completely braked, it shows a very slow speed $v_2$ in comparison to the entry speed $v_0$. Therefore, bumping of the very slowly moving printed product 02, against the buffer 09, is very gentle and very little kinetic energy is released. Starting at the time $t_1$, at which the contact between the printed product 02 and the cams 14 is discontinued, the control unit 19 can now accelerate the toothed belt 12 back up to the speed $v_1$ in order to synchronize the cams 13 or 14 with the speed of the incoming, following printed product 02.

FIG. 5 shows the development of the speed "v" of a printed product 02, in the course of passing through the braking path 24, in connection with a further simplified embodiment of the longitudinal folding apparatus 01 in accordance with the present invention. The disk 15, which is supporting the cams 13, 14 (or by the endless belts 12), is driven at a constant speed. Here, too, the printed product 02 enters the longitudinal folding apparatus 01 at the entry speed $v_0$. This time, the cams 14 or 13 precede the printed product 02 at a speed $v_3$, which is reduced, in comparison with the speed $v_1$ that was used in connection with FIG. 4. At the time $t_0$, the printed product 02 has caught up with the more slowly cams 14 or 13 and bumps against them. The speed "v" of the printed product 02 is reduced from $v_0$ to $v_3$, which is the speed of the cams 14 or 13. Between the time $t_0$ and the time $t_1$, at which the printed product 02 reaches the effective range of the braking brushes 09, the speed $v_3$ of the cams 14 or 13, and therefore the speed "v" of the printed product 02, remains approximately constant. However, for the disk 15 this speed relationship only applies approximately to a contact range within a narrow angle of rotation, such as, for example, less than 20°. Following the vertex point of the cam 13, which is the point of the shortest spacing distance of the tip of the cam 13 from the folding table 04, which vertex point is distinguished in that the line which connects the center of the disk 15 with the front edge of the cam 13 extends perpendicularly with respect to the plane of the folding table 04, at a constant rotary speed, the cam 13 now runs away, or separates itself from the braked printed product 02 in the plane of the folding table 04 at a slightly faster speed. This increased separation speed is not specifically represented in FIG. 5.

The printed product 02 is now further braked by the braking brushes 09, which further speed reduction becomes noticeable by a curvature of the graph which had been straight up to that time, while the cams 14 or 13 continue to run, so that they become again separated from the printed product 02. Finally, at the time $t_2$ the printed product 02 bumps against, or engages the stationary buffer 08 at the speed $v_4$ and is thereby completely braked.

If, for a simpler estimation, the effect of the braking brushes 09 on the speed "v" is not considered, by assuming that no braking brushes 09 were provided, and if it is further assumed that the speed $v_3$ of the cams is half the magnitude of the entry speed $v_0$ of the printed product 02, the same amount of kinetic energy is released during the bumping of the printed products 02 against the cams 14 or 13 as is released in the course of the bumping of the printed product 02 against the buffer 08. This is because, during both bumping processes, the same amount of relative speed between the printed product 02 and the cams 14, 13, or at the buffer 08, prevails. This means that during both bumping processes just one fourth of the amount of kinetic energy is set free as would be released if the printed product 02 were to bump against, or impact, the stationary bumper 08 at the unbraked entry speed $v_0$. If the braking brushes 09 are provided, it is possible to select $v_3>v_0/2$, and $v_4>v_0/2$, so that both of bumping or impact processes are softened.

In an advantageous embodiment of the present invention, and with the disk 15, the bumping point or impact point of the product 02 with the cam 13 is located ahead of the vertex of the cam 13, or, in other words, is located ahead of the point of the shortest distance of the free end or tip of the cam 13 from the folding table 04, which shortest distance is distinguished by the line which connects the center of the disk 15 with the front edge of the cam 13, and which line is extending perpendicularly with respect to the plane of the folding table 04.

The longitudinal folding apparatus 01, with the disks 15, or with the endless belts 12, arranged underneath the folding table 04, is preferred, particularly in the situation in which the disks 15, or the endless belts 12, together with the gear wheels 11, as well as the motor 16 or the motors 16, have been fixedly installed in the table. The longitudinal folding apparatus 01, with the disks 15, or the endless belts 12, arranged above the folding table 04 is preferred in the case where the toothed belts 12, with the gear wheels 11, and with the motor 16, are intended to be configured as a removable module.

Figure 8:
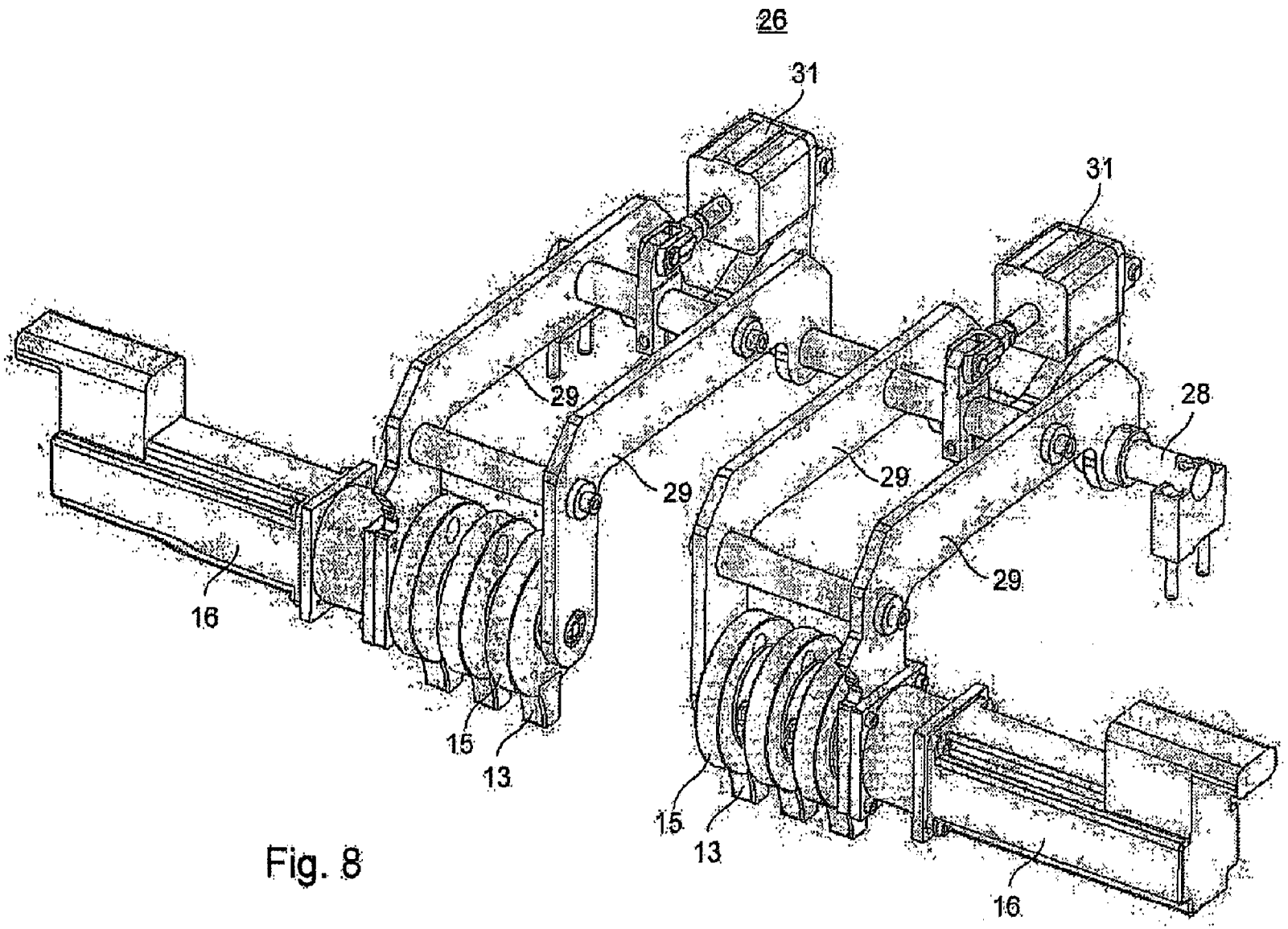

FIG. 8 shows, in a perspective view, an advantageous embodiment of a braking arrangement 26, in accordance with the present invention, and having a movable buffer 13, 14. Braking arrangement 26 has a group of several, and here has four, disks 15 on each of the two sides of the folding gap 06. Each disk 15 supports one cam 13 on its circumference, and each group of disks 15 is driven by a motor 16. In principle, this arrangement could be either releasably or non-releasably connected with a frame 27 or support 27, or with the folding table 04, as is depicted in FIG. 9. However, in an advantageous arrangement of the present invention, the braking device 26 is configured as a module 26 which is arranged to be movable with respect to the frame 27 in such a way that the space directly above the folding table 04 can be kept clear. To accomplish this end, the braking device 26 is seated so that it is pivotable with respect to the frame 27. The braking device 26 has groups of supports 29 for receiving the disks 15, which supports 29 are either pivotable around a shaft 28 that is fixed in place on the frame, or are pivotable around a shaft 28 which is rotatably seated on the frame 27. Pivoting of the supports 29 can take place either manually or, as represented, by drive assemblies 31, such as, for example, by one or by several cylinders, which cylinders can be charged with a pressure medium. To this end, the cylinder is intended to be fixed on the frame, for example, and the piston end is hinged to the supports 29, or vice versa. Fixed on the frame is understood here to include that the seating of the shaft 28, or of the cylinder, can be connected with further components, which further components are arranged in a fixed orientation with respect to the frame 27 or to the folding table 04. If now the folding table 04, or the folding blade 03 is to be made accessible, the braking device is pivoted away by actuating the drive means 31. Alternatively this pivotal movement can be accomplished manually. The braking module 26, whether it is arranged movably or fixed on the frame, is suitable, in a particularly simple manner, for use in retrofitting conventional longitudinal folding apparatuses 01.

The principle of operation and utilization of the movable buffers 13, 14, as well as the particular embodiments of the arrangement, in accordance with the present invention can be advantageously used, considered by themselves, but can also be used, as a whole, within a system 32 with alternative processing sections.

Figure 10:
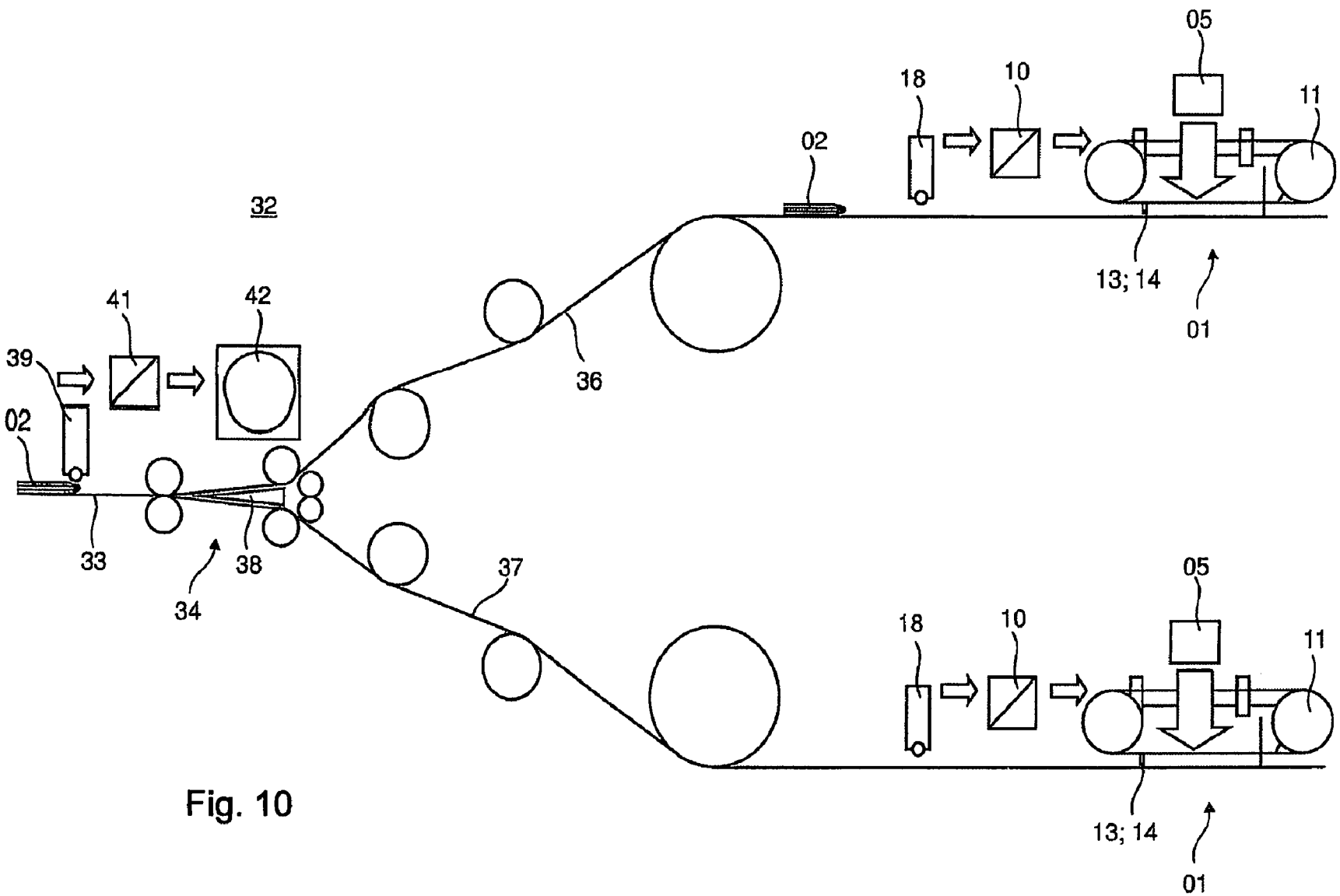

FIG. 10 schematically shows such a system 32, with alternative processing sections, for use in further processing products 02, such as, for example, intermediate products 02, and in particular for use in the further processing of printed products 02 in a folding apparatus.

Intermediate products 02, such as, for example, products 02 which are already transversely cut and/or which are transversely folded sections of printed products, are conveyed along a track 33, such as, for example, a conveying track 33, toward a shunt 34, such as, for example, a splitting device 34. At the shunt 34, the transport track 33 is split into several, and here as specifically illustrated as two alternative tracks 36, 37, such as, for example, two transport tracks 36, 37, and in particular, into two processing tracks 36, 37, for use in accomplishing the further processing of the intermediate products 02. The splitting device or shunt 34 has, for example, tongues 38, such as, for example, splitting tongues 38, which splitting tongues 38 are arranged to be movable in such a way that, depending on the position of the splitting tongues 38, each incoming product 02 is guided into one or the other of the two alternative transport track 36, 37. In this way, it is possible to, for example, alternatively guide respectively one product 02 into one or into the other transport track 36, 37 and to feed the product 02, depending on which one of the two alternative transport tracks 36, 37 it is fed to, to transport it to two different downstream located processing stages 01. Transporting of the products 02 on the tracks 33, 36, 37 can, in principle, take place in the most diverse manner by the use of transport systems, such as, for example, by belt or chain conveyors, or by the use of belt or belt systems which enclose the products 02 on both sides. The transport systems of the several tracks 33, 36, 37 can be driven by several drive mechanisms, which are independent of each other, or can be driven by a common drive mechanism.

In conventional systems, clocking, timing or synchronization of the splitting device 34, or of the splitting tongue 38, with the product 02, takes place mechanically by coupling it with a drive mechanism of a processing stage and/or of the transport system. The disadvantage of such a system resides in that products 02 which may have slipped, with respect to the transport system, or products 02 which were supplied too late or which were supplied too early to the transport system, pass the shunt 34 at the wrong moment. The result is that incorrect guidance, or even jamming of the shunt 34 and a stop of the product transport, can result.

The system 32 represented in FIG. 10 is constructed with an optical detection device which is usable to determine the position of the products, or a phase relation of the products. For this purpose, the system has a sensor 39 for use in detecting a position of the products, or a phase relation of the products. Sensor 39 may be, for example, an optical sensor 39 which is located preferably at a short distance upstream of the shunt 34, such as, at a distance of, for example, at most five product lengths, and particularly advantageously at a distance of less than two product lengths before the shunt 34. The sensor 39 can detect the entry of the product 02 into the field of view, the exit of the product 02 from the field of view and/or its transport speed, and can output an appropriate signal. The output signal from the sensor 39 is provided to a control device 41, which control device 41, in turn, controls a drive mechanism 42 of the shunt 34. The control device 41 is configured to synchronize the phase relation of the shunt 34 by use of the signal, and in particular to synchronize the position or phase of the splitting tongue 38, with the arrival of the product 02.

In a first variation of a discontinuously operated drive mechanism 42, the shunt 34 is brought into the required position by the drive mechanism 42, such as, for example, by respective signals. This means that a shunt placement, which is respectively caused by a signal, is provided in the sequence of the detected products. A number of the products 02, which are possibly located on the path, or the conveying track 33, between the shunt 34 and the distant sensor 39 must be taken into consideration if the distance between the two is more than one product length 02.

In an advantageous variation of the present invention, the drive mechanism 42, which may be, for example, configured as a motor 42, is operated continuously and drives the splitting tongue 38 by the use of a gear, such as, for example, a crank gear. The number of revolutions and/or the position of the motor 42 is set by the control device 41, and is synchronized to the product flow in such a way that, when a product 02 enters the shunt 34, the splitting tongue 38 is in the desired position. For example, this synchronization can take place by taking into consideration the distance between the sensor 39 and the shunt 34 and the product speed. The speed of travel of the product 02 can be detected, for example either by the use of the sensor 39, or can be determined from information regarding the speed of the transport system on the conveying track 33. If the phase relation and/or the phase velocity between the signal for detecting the product 02 and that of the splitting tongue 38 no longer agrees, a correction of the rotary position and/or number of revolutions of the drive mechanism 42, by the use of the control device, takes place. The exact synchronization between the product entry into the shunt 34 and the shunt position is possible by this coordination.

The above-described optical detection, in the approach area of the shunt 34, along with the appropriate control of the shunt 34 is, in principle, advantageously usable in systems with alternative transport track 36, 37 for the products 02. However, this applies, in particular, within the framework of a system 32 with alternative processing tracks 36, 37 for intermediate products 02, and, in particular, for printed products 02, whose overall or total product flow is split in accordance with fixed standards, or is guided into a definite processing track, and wherein the split product flows are intended to be conducted to different processing stages for further processing. Such different processing stages can basically be, for example, folding, gluing, labeling, stamping, stacking, binding and/or stapling devices. In conventional systems, the clocking, timing or synchronization of the specific processing stage, such as, for example, the synchronization of the folding blade 03 of a folding apparatus, with the product 02 takes place mechanically by the coupling of the specific processing stage with the drive mechanism of an upstream or a downstream arranged processing stage or with the transport system which is conveying the product 02. Again, the disadvantage here is that products 02 which have slipped with respect to the transport system, or products 02 which were supplied too late or too early to the transport system, can block the processing stage, or can, at least lead to erroneous product processing, such as, for example, to the formation of a wrongly placed fold. Furthermore, increased wear of the transport system, such as, for example, the belt system, or of the processing stage itself can be the result of such lack of synchronization.

The product processing system 32, which is represented in FIG. 10, is configured with the optical detection of the product position taking place upstream of the processing stage. System 32 has two alternative processing tracks 36, 37, each with a processing stage in the form of a longitudinal folding apparatus 01 having a processing tool which is embodied as a folding blade. The longitudinal folding apparatuses 01 can each be conventional longitudinal folding apparatuses, or advantageously can be longitudinal folding apparatuses 01 in accordance with one of the above-mentioned embodiments and which are provided with a disk 15, or an endless belt 12, and which have a tool 03 that is embodied as a folding blade 03, and in particular, which is embodied as a mechanically independently driven folding blade 03.

Figure 3:
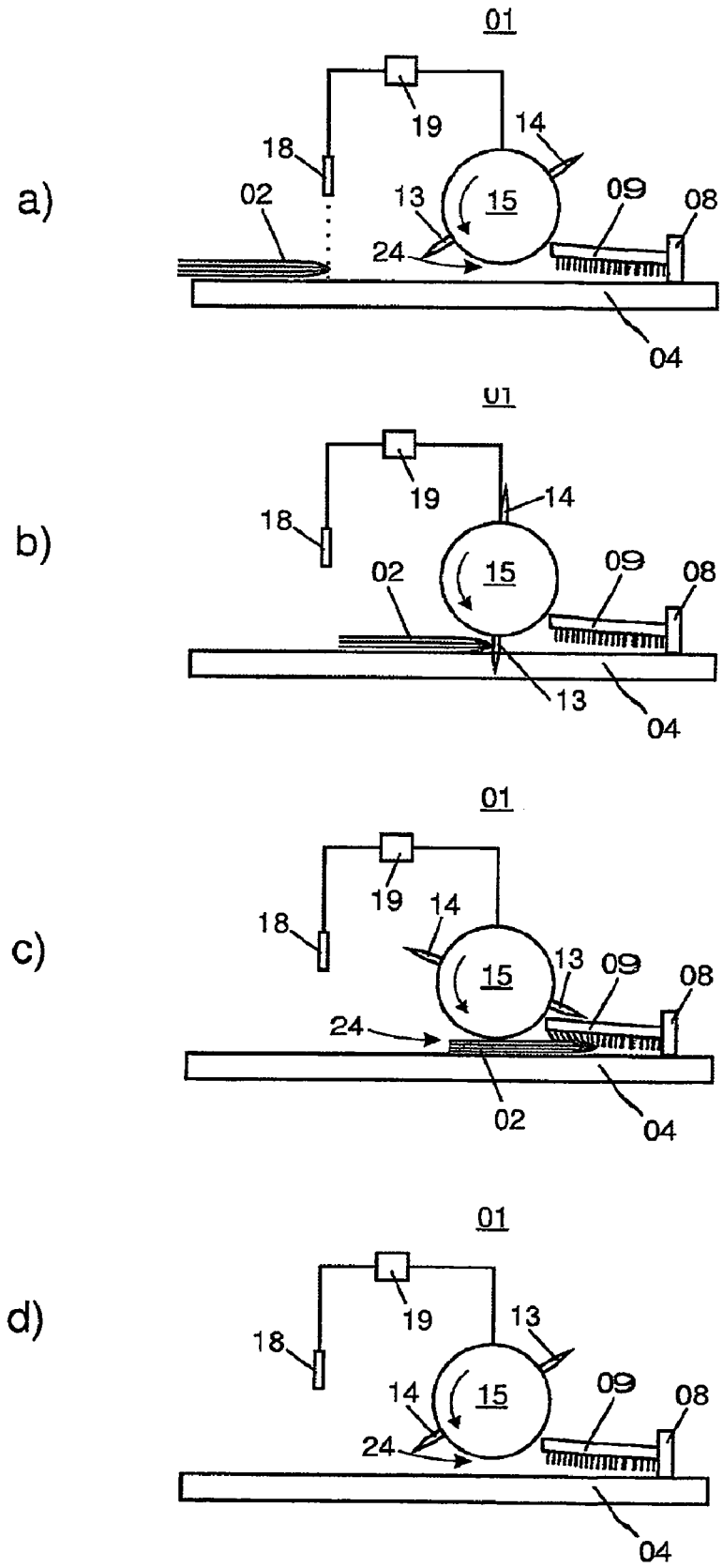

The upper and/or the lower longitudinal folding apparatus 01, as depicted in FIG. 10, and preferably both has a drive mechanism 05 for the respective folding blade 03, which folding blade drive mechanism 05 is mechanically independent from the transport system, as well as a sensor 18 that is located upstream of the folding gap 06 and which sensor 18 is usable for selecting, or determining the position, or a passage time, of a product 02, or in other words the product phase relation. The movement of the folding blade 03 can be synchronized to the product phase or location by the use of the control device 10. The sensor 18 for each alternative transport track detects the time of the passage of a product 02. The synchronization of the movement of the folding blade 03 or, in case of a deviation from a desired value, the folding time, is corrected by the control device 10. If the longitudinal folding apparatus 01 additionally has a movable buffer 13, 14 in accordance with the embodiments described above, such a movable buffer 13, 14 can also be synchronized via the associated control unit 19, as seen in FIGS. 1 to 3. The drive mechanism control unit 10 for the folding blade motor 05 and the control unit 19 for the movable buffer drive motor 16 can here be structurally combined and, if desired, can be a part of a higher order control arrangement.

A particularly advantageously embodied system 32, in accordance with the present invention in which a product flow is split in accordance with fixed standards, and in which the split product flows are intended to be fed to different processing stages for further processing, and in particular are intended to be fed to longitudinal folding apparatuses 01, are configured with an above mentioned optical detection device for use in detecting the product position upstream of the shunt 34, as well as for detecting the product position upstream of, or in the entry area of the alternative processing stages 01.

The above-described longitudinal folding apparatuses 01 are preferably embodied as a so-called third fold. A first, longitudinal folding unit, such as, for example, a former, as well as a second, transverse folding apparatus, such as, for example, a folding jaw cylinder working together with a folding blade cylinder, are arranged upstream, or before, in a direction of product travel, the third fold forming apparatuses 01.

While preferred embodiments of a system comprising alternative processing sections for the further processing of products, longitudinal folding device and method for the synchronous operation of a folding device, in accordance with the present invention, are set forth fully and completely hereinabove, it will be apparent to one of skill in the art that various changes in, for example the type of printing presses used, the types of upstream processing devices, and the like could be made without departing from the true spirit and scope of the present invention, which is accordingly to be limited only by the appended claims.

What is claimed is:

1. A product folding apparatus comprising:

a transport track to transport a product and having a transport track drive mechanism, said transport track drive mechanism moving the product along said transport track in a product transport direction;

a longitudinal folding apparatus connected to said transport track to receive the product from said transport track and to fold said product longitudinally in said product transport direction;

a vertically reciprocable folding blade positioned in said longitudinal folding apparatus and being aligned in said product transport direction;

a folding table supporting said folding blade for said vertically reciprocable movement of said folding blade with respect to said folding table;

a folding blade drive motor to vertically reciprocate said folding blade with respect to said folding table through a folding blade drive mechanism, said folding blade drive motor being controlled independently of said transport track drive mechanism;

a folding blade drive motor control device to provide said independent control of said folding blade drive motor to vertically reciprocate said folding blade at a product folding time when said product is aligned beneath said vertically reciprocable folding blade on said folding table;

an optical product sensor located adjacent said folding table and before said folding blade in said product transport direction, said optical product sensor being usable to determine a product phase relation of said product at said product sensor location; and means for controlling said folding blade drive motor, using said folding blade motor control device, in response to said product phase relation determined by said optical product sensor at said product sensor location, and before said folding blade, to synchronize said vertical reciprocation of said folding blade, at said product folding time, with said product alignment on said folding table, beneath said vertically reciprocable folding blade with said determined product phase relation of said product to be folded, as said product phase relation has been determined by said optical product sensor, to longitudinally fold said product in said product transport direction.

2. The product folding apparatus of claim 1 further including a folding blade support lever pivotably attached to said folding table and supporting said folding blade for said vertically reciprocable movement with respect to said folding table.

3. The product folding apparatus of claim 1 further including a movable buffer in said longitudinal folding apparatus and usable to slow down a product entering said longitudinal folding apparatus along a product travel path at a product entry speed.

4. The product folding apparatus of claim 3 further including means moving said buffer along said product travel path at a buffer speed less than said product entry speed.

5. The product folding apparatus of claim 3 wherein said movable buffer is an endless belt and further including a rotatable body supporting said endless belt, said endless belt extending along said product travel path.

6. The product folding apparatus of claim 3 wherein said movable buffer is a moving endless belt having a section extending along said product travel path.

7. The product folding apparatus of claim 3 wherein said product sensor is usable to synchronize said movement of said buffer using said product phase relation.

8. The product folding apparatus of claim 3 further including a buffer drive mechanism which is independent of said transport drive mechanism.

9. The product folding apparatus of claim 8 wherein said product sensor controls said buffer drive mechanism.

10. The product folding apparatus of claim 1 further including a shunt arranged before, in a direction of product travel, said longitudinal folding apparatus and usable to selectively supply products to said longitudinal folding apparatus.

11. The product folding apparatus of claim 10 further including a shunt drive mechanism and a shunt drive mechanism control device and further including a shunt sensor located before said shunt and usable to actuate said shunt drive mechanism control device.

12. The product folding apparatus of claim 11 wherein said shunt drive mechanism control device synchronizes a shunt operating position with a detected product phase relationship using said shunt sensor.

* * * * *